US007563113B2

(12) United States Patent
Sheng

(10) Patent No.: US 7,563,113 B2
(45) Date of Patent: Jul. 21, 2009

(54) WATERPROOF PLUG FOR DATA PORT OF PORTABLE ELECTRONIC DEVICE

(75) Inventor: Yen-Long Sheng, Jhonghe (TW)

(73) Assignee: Mitac Technology Corp., Hsin-Chu Hsien (TW)

( * ) Notice: Subject to any disclaimer, the term of this patent is extended or adjusted under 35 U.S.C. 154(b) by 0 days.

(21) Appl. No.: 12/005,296

(22) Filed: Dec. 27, 2007

(65) Prior Publication Data

US 2008/0268706 A1 Oct. 30, 2008

(30) Foreign Application Priority Data

Apr. 28, 2007 (CN) ..... 2007 1 0027754

(51) Int. Cl.
*H01R 13/44* (2006.01)

(52) U.S. Cl. ..... 439/135; 439/271; 439/587

(58) Field of Classification Search ..... 439/135, 439/136, 142, 148, 149, 271, 276, 289, 521, 439/587

See application file for complete search history.

(56) References Cited

U.S. PATENT DOCUMENTS 6,141,667 A * 10/2000 Duff ..... 708/100
6,547,581 B2 * 4/2003 Zweigle et al. ..... 439/271
7,048,556 B2 * 5/2006 Stanton et al. ..... 439/135
7,150,638 B1 * 12/2006 Fonville et al. ..... 439/148
7,189,084 B2 * 3/2007 Iikura ..... 439/135
2004/0214464 A1 * 10/2004 Fukushima et al. ..... 439/271
2005/0124191 A1 * 6/2005 Stanton et al. ..... 439/135
2008/0268706 A1 * 10/2008 Sheng ..... 439/587

* cited by examiner

*Primary Examiner*—James Harvey
(74) *Attorney, Agent, or Firm*—Quintero Law Office

(57) ABSTRACT

A waterproof plug includes a cover plate for closing an outward-directed access of a data port provided on a main body of a portable electronic device; and an approximately hexagonally shaped sealing flange perpendicularly extended from a data port sealing surface of the cover plate for fitly engaging into the access of the data port to seal the same. A water-guiding groove is provided along the sealing flange at a position adjacent to the cover plate. Rainwater falling on the top of the cover plate and the sealing flange immediately flows downward due to its weight to the water-guiding groove and two lateral sides of the sealing flange without accumulating or leaking into the data port to cause damage to the portable electronic device.

15 Claims, 3 Drawing Sheets

WATERPROOF PLUG FOR DATA PORT OF PORTABLE ELECTRONIC DEVICE

FIELD OF THE INVENTION

The present invention relates to a waterproof plug for data port of a portable electronic device, and more particularly to a waterproof plug for data port of a portable electronic device for military or industrial purpose.

BACKGROUND OF THE INVENTION

A waterproof computer is usually designed for military or industrial purpose to be operated in severe environments. Therefore, it is necessary for all components of the waterproof computer to be repellent to water. All connections on the computer that are exposed to external environment must have a waterproof plug installed thereat to protect the connections from flooding of water.

FIG. 1 is a sectioned side view showing a conventional waterproof plug for a data port 10 provided on an outer surface of a portable computer. The conventional waterproof plug includes a sealing flange 22 for fitly plugging into the data port 10 via an access 11 thereof to bear against the inner wall surface 12 of the data port 10, so that a cover plate 21 located at an outer end of the sealing flange 22 is completely and closely attached to the outer surface of the portable computer surrounding the access 11 of the data port 10 to prevent water from entering into the data port 10.

For the above-structured waterproof plug to provide waterproof effect, the sealing flange 22 must be fully plugged into the data port 10 for the cover plate 21 to completely and tightly attach to the outer surface of the portable computer. In the case of using the portable computer outdoors in a heavy raining day, rainwater tends to accumulate at the upper part of the cover plate 21 and could not be timely drained. The accumulated rainwater would finally leak from the sealing flange 22 into the data port 10 to cause damage to the portable computer.

SUMMARY OF THE INVENTION

A primary object of the present invention is to provide an easily operable waterproof plug for data port on a portable electronic device to effectively prevent external water from accumulating and leaking into the data port to cause damage to the portable electronic device.

To achieve the above and other objects, the waterproof plug for a data port on a portable electronic device according to the present invention includes a cover plate for closing an outward directed access of the data port provided on a main body of the portable electronic device; and an approximately hexagonally shaped sealing flange perpendicularly extended from a data port sealing surface of the cover plate for fitly engaging into the access of the data port to seal the same. A water-guiding groove is provided along the sealing flange at a position adjacent to the cover plate.

Preferably, the waterproof plug further includes a mounting plate perpendicularly extended from a lower edge of the cover plate. When the cover plate is closed to the outward directed access of the data port, the mounting plate is externally located beneath a bottom surface of the main body of the portable electronic device and may be connected thereto using at least one screw.

Preferably, the mounting plate is provided at a position corresponding to the water-guiding groove with at least one water draining hole.

Preferably, the water-guiding groove has a curved or a rectangular cross section.

Preferably, a surface of the sealing flange closer to an upper side of the main body of the portable electronic device has a middle section higher than the other sections at the two lower lateral areas, which are curved surfaces or inclined plane surfaces.

Preferably, the waterproof plug is made of a rubber material.

Preferably, the portable electronic device is a notebook computer for military or industrial purpose.

The waterproof plug for data port of a portable electronic device according to the present invention is superior to the prior art in that a water-guiding groove is provided along the sealing flange adjacent to the cover plate. Therefore, in the event a user did not plug the waterproof plug fully into the data port via the outward directed access thereof, and the cover plate did not fully close the access of the data port, rainwater falling on the top of the sealing flange would still immediately flow downward due to its weight to the water-guiding groove without accumulating and leaking into the data port to cause damage to the portable electronic device.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
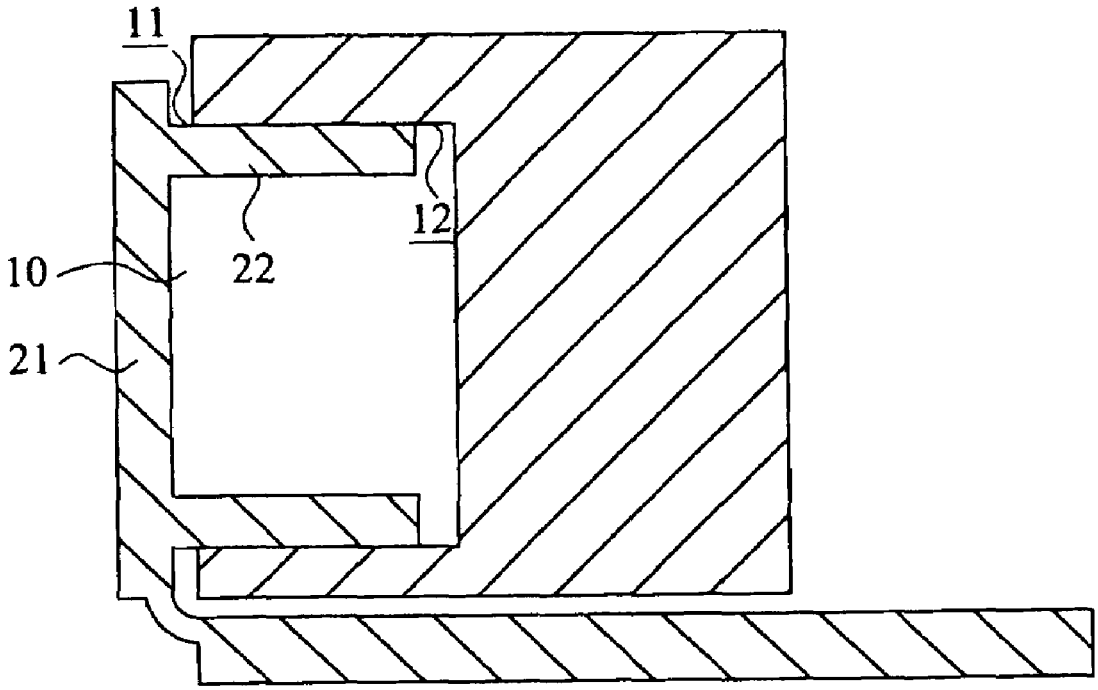
FIG.1(Prior Art)
FIG. 1 is a sectioned side view of a conventional waterproof plug for data port of portable computer.
Figure 2:
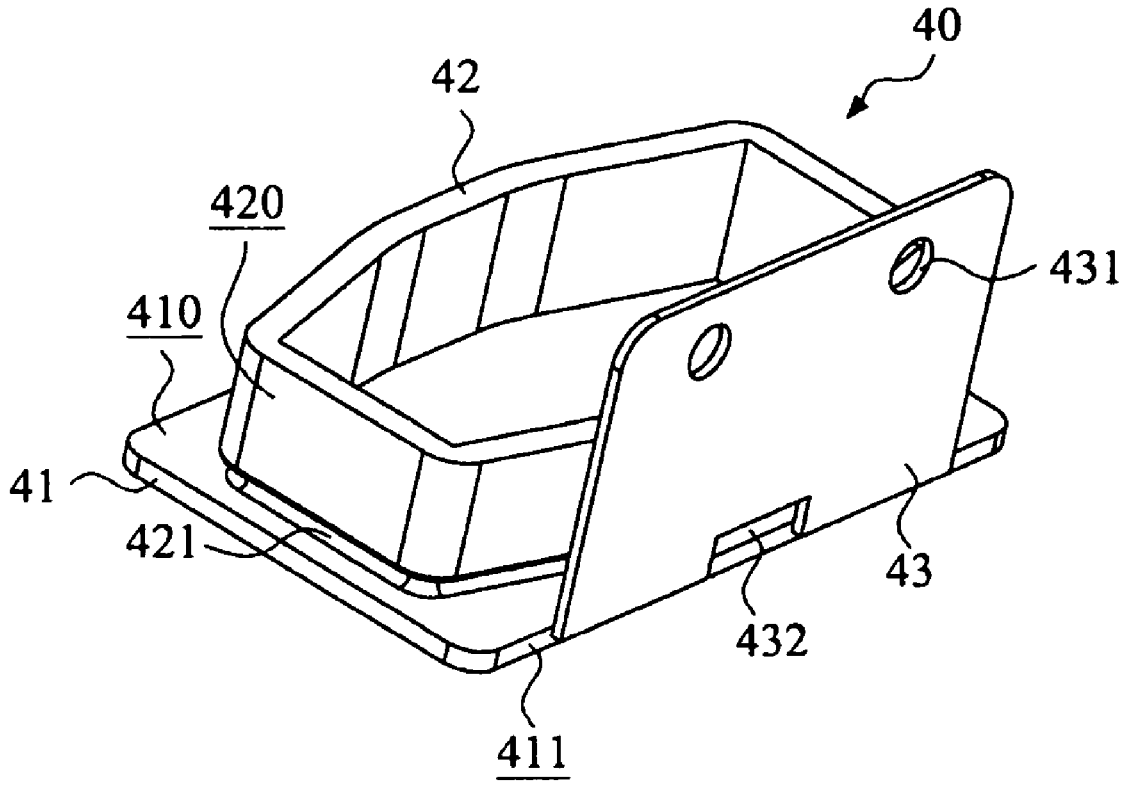
FIG. 2 is a perspective view of a waterproof plug for data port of portable electronic device according to a preferred embodiment of the present invention.

Please refer to FIG. 2 that is a perspective view of a waterproof plug for data port of a portable electronic device according to a preferred embodiment of the present invention. The waterproof plug is generally denoted a reference number 40, and includes a cover plate 41, a sealing flange 42 perpendicular to and extended from a data port sealing surface 410 of the cover plate 41 by a predetermined distance, and a mounting plate 43 extended from a lower edge 411 of the cover plate in an extension direction the same as that of the sealing flange 42. A water-guiding groove 421 is formed along the sealing flange 42 at a position adjacent to the cover plate 41. The mounting plate 43 is provided at predetermined positions corresponding to the water-guiding groove with at least one through hole 431 and at least one water draining hole 432. Preferably, the sealing flange 42 has a cross section approximately in the form of a hexagon.

Figure 3:
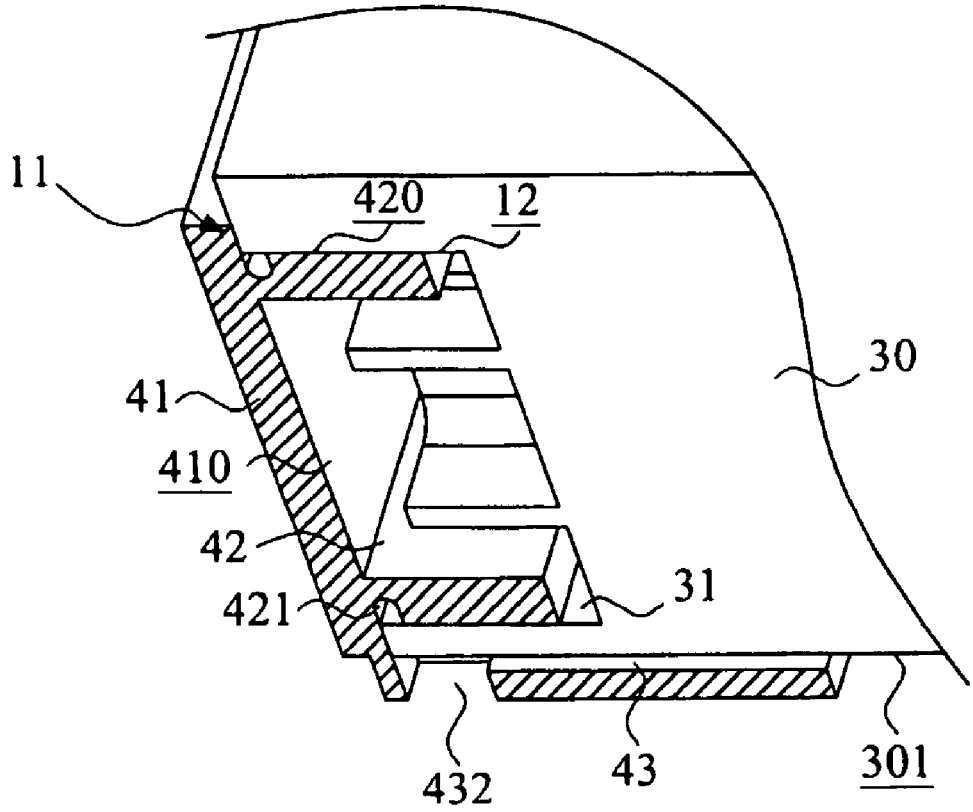
FIG. 3 is a sectioned perspective view of the waterproof plug for data port of portable electronic device according to the preferred embodiment of the present invention.

Please refer to FIG. 3 that is a sectioned perspective view of the waterproof plug for data port of portable electronic device according to the preferred embodiment of the present invention. The portable electronic device has a main body 30 being provided at a predetermined position with a data port 31, which has an outward directed access 11 and an inner wall surface 12 to define an internal space. The waterproof plug 40 may be fitly plugged into the internal space of the data port 31 via the outward directed access 11 to seal the same against water. When the waterproof plug 40 is plugged into the data port 31, the mounting plate 43 is located beneath a bottom surface 301 of the main body 30 of the portable electronic device, and connected to the main body 30 using at least one screw.

When the portable electronic device is used outdoor and exposed to rainwater, rainwater fallen on a continuous outer surface 420 of the sealing flange 42 of the waterproof plug 40 immediately flows into the water-guiding groove 421 without accumulating on the sealing flange 42 for a long period of time or leaking into the data port 31 to cause damage to the portable electronic device. Moreover, with the hexagonal configuration of the sealing flange 42, water fallen and accumulated on the outer surface 420 of the sealing flange 42 would, due to its weight, automatically flow from a higher position to other lower positions on the sealing flange 42, and is finally drained via the water draining hole 432 to the outside and gets out of the portable electronic device.

The sealing flange 42 may be provided on a top of its outer surface 420 with a middle section higher than other sections at two lateral sides of the middle section to facilitate natural flowing of rainwater from the sealing flange 42 to the water draining hole 432. Therefore, any means provided on the top surface of the sealing flange 42 that enables rainwater to downward flow to two lateral sides of the sealing flange 42 and the water draining hole 432 due to its weight should be considered as fallen in the scope of the present invention as defined in the appended claims.

With the above arrangements, the waterproof plug for data port of a portable electronic device according to the present invention effectively prevents water flowing onto the waterproof plug 40 to accumulate on the sealing flange 42 and leak into the data port 31 on the main body 30 of the portable electronic device. Therefore, the portable electronic device is protected against damage caused by rainwater when being used outdoor in a raining day. In the event a user did not plug the waterproof plug 40 fully into the data port 31 via the outward directed access 11, and the cover plate 41 does not fully close the access 11, the hexagonally shaped sealing flange 42 with the water-guiding groove 421 may still effectively prevent rainwater from accumulating and leaking into the data port 31. Meanwhile, the waterproof plug for data port of portable electronic device according to the present invention also provides the advantages of easy to manufacture and easy to operate.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A waterproof plug for plugging into a data port provided on a main body of a portable electronic device, the data port having an outward-directed access and having an inner wall surface to define an internal space therein, the waterproof plug comprising:

a cover plate having a data port sealing surface;

a sealing flange being perpendicular to and extended from the data port sealing surface of the cover plate by a predetermined distance, and having a continuous outer wall surface defining a predetermined configuration;

a water-guiding groove being provided along the continuous outer wall surface of the sealing flange at a position adjacent to the cover plate;

a mounting plate, which is extended from a lower edge of the cover plate in an extension direction the same as that of the sealing flange, such that when the sealing flange of the waterproof plug is plugged into the internal space of the data port, the mounting plate is externally located beneath a bottom surface of the main body of the portable electronic device; and at least one through hole provided on the mounting plate for a screw to thread therethrough to thereby fasten the mounting plate to the bottom surface of the main body of the portable electronic device;

whereby when the sealing flange of the waterproof plug is plugged into the internal space of the data port via the access thereof, the cover plate is faced toward and fitly closes the access of the data port with the continuous wall surface of the sealing flange tightly bearing against the inner wall surface of the internal space of the data port.

2. A waterproof plug for plugging into a data port provided on a main body of a portable electronic device, the data port having an outward-directed access and having an inner wall surface to define an internal space therein, the waterproof plug comprising:

a cover plate having a data port sealing surface;

a sealing flange being perpendicular to and extended from the data port sealing surface of the cover plate by a predetermined distance, and having a continuous outer wall surface defining a predetermined configuration; and a water-guiding groove being recessed into an entire circumference of the continuous outer wall surface of the sealing flange at a position directly adjoining the cover plate;

whereby when the sealing flange of the waterproof plug is plugged into the internal space of the data port via the access thereof, the cover plate is faced toward and fitly closes the access of the data port with the continuous wall surface of the sealing flange tightly bearing against the inner wall surface of the internal space of the data port.

3. The waterproof plug as claimed in claim 1, wherein the mounting plate is provided at a position corresponding to the water-guiding groove around the sealing flange with at least one water draining hole.

4. The waterproof plug as claimed in claim 1, wherein the water-guiding groove has a cross section selected from the group consisting of a curved cross section and a rectangular cross section.

5. The waterproof plug as claimed in claim 1, wherein the outer wall surface of the sealing flange has a middle section that is higher than other sections of the outer wall surface at two lateral sides of the middle section.

6. The waterproof plug as claimed in claim 5, wherein the outer wall surface of the sealing flange has an approximately hexagonal configuration.

7. The waterproof plug as claimed in claim 1, wherein the cover plate is made of a rubber material.

8. The waterproof plug as claimed in claim 1, wherein the portable electronic device is a notebook computer for military or industrial purpose.

9. The waterproof plug as claimed in claim 2, wherein the portable electronic device is a notebook computer for military or industrial purpose.

10. The waterproof plug as claimed in claim 2, further comprising:

a mounting plate, which is extended from a lower edge of the cover plate in an extension direction the same as that of the sealing flange, such that when the sealing flange of the waterproof plug is plugged into the internal space of the data port, the mounting plate is externally located beneath a bottom surface of the main body of the portable electronic device; and at least one through hole provided on the mounting plate for a screw to thread therethrough to thereby fasten the mounting plate to the bottom surface of the main body of the portable electronic device.

11. The waterproof plug as claimed in claim 10, wherein the mounting plate is provided at a position corresponding to the water-guiding groove around the sealing flange with at least one water draining hole.

12. The waterproof plug as claimed in claim 2, wherein the water-guiding groove has a cross section selected from the group consisting of a curved cross section and a rectangular cross section.

13. The waterproof plug as claimed in claim 2, wherein the outer wall surface of the sealing flange has a middle section that is higher than other sections of the outer wall surface at two lateral sides of the middle section.

14. The waterproof plug as claimed in claim 13, wherein the outer wall surface of the sealing flange has an approximately hexagonal configuration.

15. The waterproof plug as claimed in claim 2, wherein the cover plate is made of a rubber material.

* * * * *